US005353665A

United States Patent [19]

Heebner

[11] Patent Number: 5,353,665

[45] Date of Patent: Oct. 11, 1994

[54] AUTOMATED CONTAINER CLOSURE OPENER

[76] Inventor: William D. Heebner, 3513 Edencroft Dr., Raleigh, N.C. 27612

[21] Appl. No.: 964,646

[22] Filed: Oct. 21, 1992

Related U.S. Application Data

[63] Continuation-in-part of Ser. No. 815,339, Dec. 27, 1991, Pat. No. 5,167,172.

[51] Int. Cl.[5] ..... B67B 7/18

[52] U.S. Cl. ..... 81/3.2

[58] Field of Search ..... 81/3.2, 3.25, 3.31, 81/3.32, 3.33, 3.07

[56] References Cited

U.S. PATENT DOCUMENTS

| | | | |
|---|---|---|---|
| 1,598,392 | 6/1926 | Risser | 81/3.2 |
| 3,795,158 | 3/1974 | Morita | 81/3.32 |
| 3,950,801 | 4/1976 | Morrison | 7/14.25 |
| 4,171,650 | 10/1979 | Cardinal | 81/3.2 |
| 4,535,585 | 8/1985 | Gardos | 81/3.2 |
| 4,762,029 | 8/1988 | Chen | 81/3.2 |
| 4,919,014 | 4/1990 | Chen et al. | 81/3.2 |

*Primary Examiner*—Roscoe V. Parker
*Attorney, Agent, or Firm*—Richard E. Jenkins

[57] ABSTRACT

An automated container closure opener for screw-type bottle or container caps, lids, caps, covers and the like comprising a housing having a base portion and a relatively vertically movable top portion operatively connected thereto by at least one telescoping shaft. A first motorized drive is provided for actuating the telescoping shaft so as to vertically move the top portion of the housing relative to the base portion, and a second motorized drive is provided for rotatably actuating a bottle cap engagement member which depends from the top portion of the opener housing. A circuit serves to actuate the first motorized drive to lower the bottle cap engagement member from an inoperative position adjacent the top portion of the housing into engaging contact with the cap of a bottle and to then deactuate the first motorized drive and actuate the second motorized drive to at least partially remove the cap from the bottle.

18 Claims, 12 Drawing Sheets

AUTOMATED CONTAINER CLOSURE OPENER

RELATED APPLICATION

This application is a continuation-in-part application of Ser. No. 07/815,339, filed Dec. 27, 1991, and now U.S. Pat. No. 5,167,172.

TECHNICAL FIELD

The present invention relates in general to a bottle or container closure opener. More particularly, the present invention relates to an automated container closure opener device.

RELATED ART

A number of container or bottle opening devices are known in the art in order to assist an individual in removing the lid or cap from a bottle or container. For example, U.S. Pat. Nos. 4,919,014 and 4,762,029 to Chen disclose a bottle closure opener which provides a substantially automated bottle cap removal device. Upon actuation, a movable platform upon which the bottle is placed vertically rises until a bottle cap gripping unit at the top of the device engages the bottle cap. Upon contact with the bottle cap gripping unit, the vertical upward movement of the platform is terminated and the bottle cap gripping unit is caused to rotatably unscrew the cap from the bottle.

Also, U.S. Pat. No. 4,171,650 to Cardinal discloses a jar lid loosening device of a somewhat similar configuration to the Chen device. The device includes a vertically movable table actuated by a first motor which serves to raise the jar into contact with a lid-receiving member which is configured so as to accommodate a range of different size lids. When the bottle has been elevated vertically upwardly so as to force the lid into secure engagement with the rotatable lid loosening element, a torque clutch slips to prevent excessive upward force. The operator then presses a switch to energize a second motor which rotatably drives the lid receiving element so as to loosen the lid from the bottle. Next, the operator releases the switch and moves the first switch from the up to the down position in order to lower the support table and to thereby remove the opened jar from the device.

Other patents of interest include U.S. Pat. No. 3,950,801 to Morrison and U.S. Pat. No. 3,795,158 to Merita.

Although bottle cap removing or loosening devices are known in the art, these known devices all suffer shortcomings which are well known to those skilled in this art. Applicant has developed a novel fully automated container closure opener which is believed to be a significant advancement in the art and to meet a long-felt need for a reliable and fully automated container closure opener.

DISCLOSURE OF THE INVENTION

In accordance with the present invention, applicant provides a bottle or container closure opener for use with screw-type bottle or container caps, lids, caps, covers, etc. and comprising a housing including a base portion with a rotatably fixed platform for supporting a bottle and a relatively vertically movable top portion positioned above the base portion. At least one telescoping shaft is provided to operatively connect the top portion to the bottom portion of the housing. A first motorized drive means carried by the top portion of the housing serves to actuate the telescoping shaft in order to vertically lower and raise the top portion of the housing relative to the base portion.

A bottle cap engagement member is mounted on a rotatable shaft and depends from the top portion of the housing, and a second motorized drive means carried by the top portion of the housing is provided for rotatably actuating the bottle cap engagement member in the bottle cap loosening direction. Circuit means is utilized to actuate the first motorized drive means in order to lower the bottle cap engagement member from an inoperative position adjacent the top portion of the housing into engaging contact with the cap of a bottle positioned on the base portion of the housing and to then deactuate the first motorized drive means and to actuate the second motorized drive means in order to at least partially remove the cap from the bottle.

It is therefore the object of the present invention to provide a fully automated container closure opener for easily and quickly loosening a screw-type cap from a bottle or container positioned thereon.

It is another object of the present invention to provide a container closure opener which is fully automated and thus does not require any additional operator activity after a bottle or container is placed thereon and the device actuated.

Some of the objects of the invention having been stated, other objects will become evident as the description proceeds, when taken in connection with the accompanying drawings.

BEST MODE FOR CARRYING OUT THE INVENTION

Figure 2:
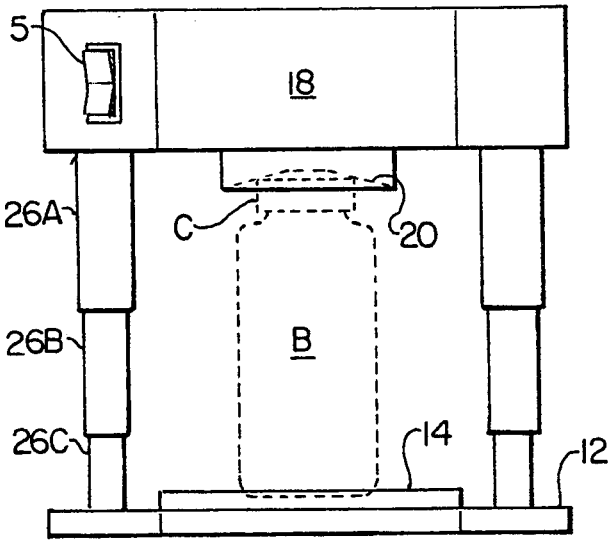
FIG. 2 is a front elevation view of the automated container closure opener of the present invention.
Figure 3:
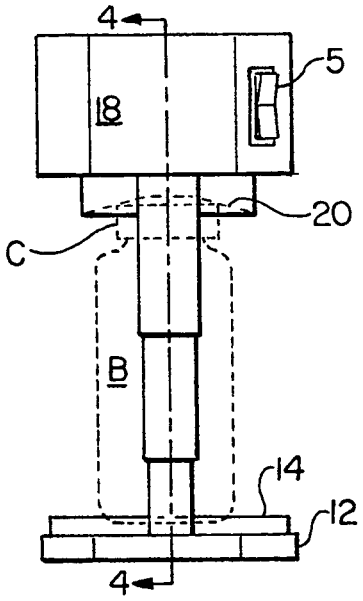
FIG. 3 is a side elevation view of the automated container closure opener of the present invention.
Figure 1:
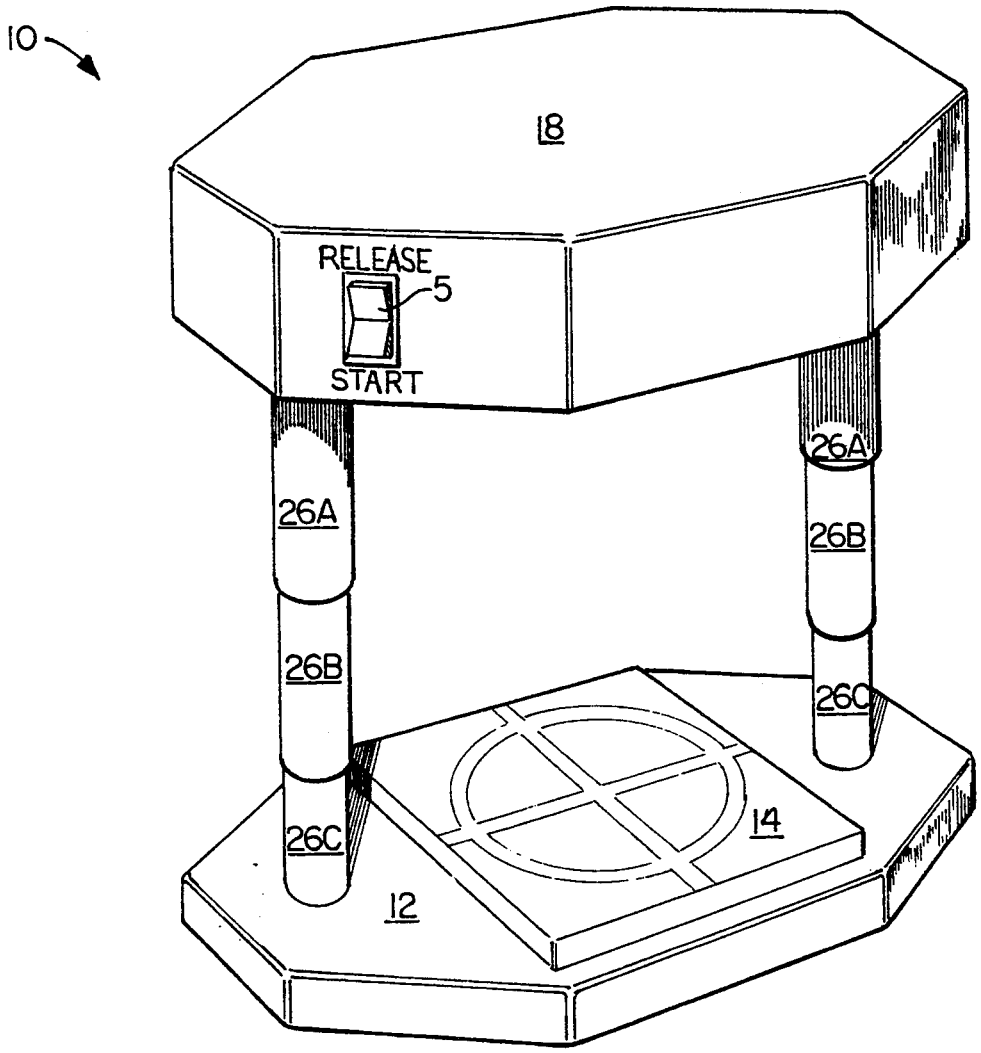
FIG. 1 is a perspective view of the automated container closure opener of the present invention.

Referring now to the drawings, the automated container closure opener is generally designated 10 therein. The baseplate 12 is a heavy foundation plate to provide support and stability for the rest of the device. Baseplate 12 has threaded holes (not shown) for attachment of renewable lower gripper 14 with suitable screws and two holes 12A and corresponding nuts 12B (see FIG. 4) for attachment of the bottom sections of the two telescoping elevator shafts 16. An upper housing 18 with an upper rotatable bottle cap gripper 20 is attached to the top of two telescoping elevator shafts 16. Depressing the start switch S on upper housing 18 energizes elevator motor 22 which through gears 22A, 22B, 22C and 22D (see FIG. 5) turns gear-nuts 24 on the screw-threaded telescoping elevator shafts 16 so as to cause upper housing 18 to descend and clamp a bottle and cap between upper and lower grippers 14 and 20, respectively.

Grippers 14 and 20 each have a covering layer of resilient elastomeric polymer of the type often popularly described as a form of silicon rubber, with a slightly gummy or adhesive rubber-like surface. Formulation of the upper gripper and lower gripper elastomeric elements may vary from each other to allow for the differences in size and texture of caps and bottles.

Lower gripper 14 is stationary with relation to the base of the opener and attached to baseplate 12. The lower gripper 14 may incorporate a circular design or other suitably shaped design on its surface to aid the user in placing a bottle near the center of the gripper.

Upper gripper 20 has a conical cap-engaging lower surface which is formed from an elastomeric material and a rigid support plate 21 therebehind. Upper gripper 20 is attached to a rotatable shaft 25 extending upwardly into housing 18. The engagement surface of gripper 20 opposes a bottle cap and as the upper housing descends, it contacts and squeezes down onto the cap of a bottle placed on lower gripper 14. The conical design of gripper 20 also helps the gripper to center the bottle cap into the gripper surface for better application of the rotational force (to be explained later) to loosen the cap. That is, the cone shape of gripper 20 slides the bottle cap towards the center thereof as it descends onto the bottle cap.

The two telescoping elevator shafts 16 formed of upper and lower sections 16A and 16B, respectively, are helically threaded screws covered with smooth collapsible housings 26A–26C for safety and appearance. Shafts 16 have two sections 16A, 16B which telescope together to allow the upper housing to move downward toward baseplate 12 a greater distance than would be possible with single rotatable shafts. In this fashion, it is contemplated that closure opener 10 can accommodate bottles of varying heights including a minimum size of about two (2) inches in height. This also provides advantages in compactness, appearance, cleanliness, and storage.

The lower sections 16B of elevator shafts 16 are fixed to baseplate 12 by a square tang to prevent rotation, and nuts 12B hold sections 16B securely in position. The lower sections 16B of elevator shafts 16 are externally threaded with a coarse thread and the upper sections 16A of elevator shafts 16 are threaded both internally and externally so as to receive lower sections 16B therein.

Figure 5:
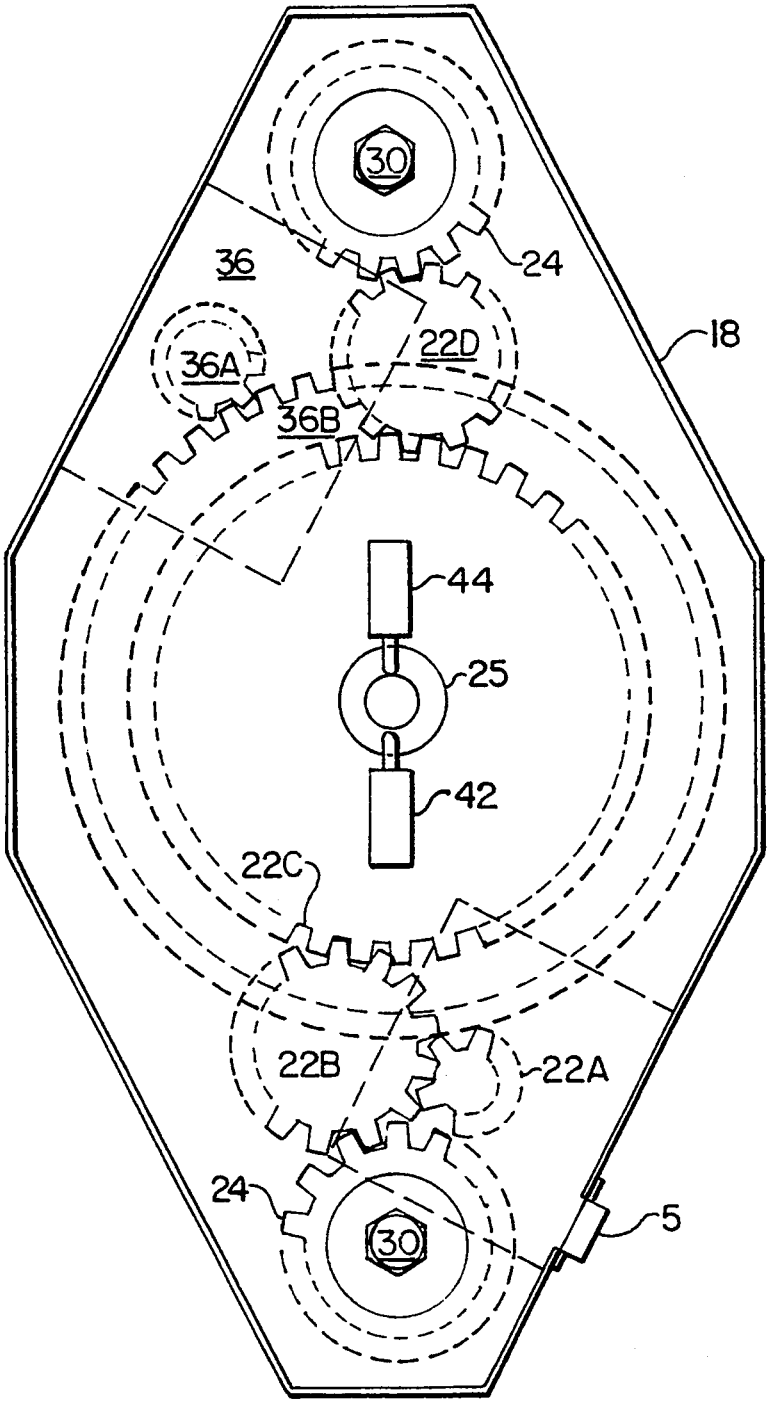
FIG. 5 is a horizontal cross sectional view through the top portion of the housing of the automated container closure opener of the present invention.

Gear-nuts 24 have internal threads with the same pitch as the external threads of upper sections 16A so as to mate with the upper sections of rotatable shafts 16, and the gear-nuts also have external teeth to mesh with gears 22B and 22D (see FIG. 5). Upper sections 16A of elevator shafts 16 have stop collars 28 and screws 30 at their upper ends to prevent them from threading out of gear-nuts 24.

The telescoping action of shafts 16 works in the following manner. An elevator motor 22 through gears 22A, 22B, 22C and 22D (see FIG. 5) turns gear-nuts 24 on upper shaft sections 16A so as to draw them upwardly into housing 18 and consequently to move housing 18 downwardly. When gear-nuts 24 bottom on upper section 16A continued turning of gear-nuts 24 turns upper sections 16A in relation to lower sections 16B. This motion serves to draw upper sections 16A down over stationary lower sections 16B and also moves housing 18 downwardly until it bottoms or until motor 22 is stopped. It is unimportant if gear-nuts 24 move relative to upper sections 16A first or if sections 16A move relative to sections 16B first since the telescoping action will be the same.

An outer covering 26A–26C is provided over telescoping shaft sections 16A and 16B and is made of three telescoping sections of light plastic tube material wherein each section is of diminishing diameter so that they will telescope together. Upper outer covering sections 26A are fixed to upper housing 18 and the lowest sections 26C are fixed to baseplate 12. The center sections 26B move relative to both as shafts 16A and 16B telescope. The outer covering is primarily aesthetic, but it also protects the user from shafts 16 and makes cleaning easier.

Figure 4:
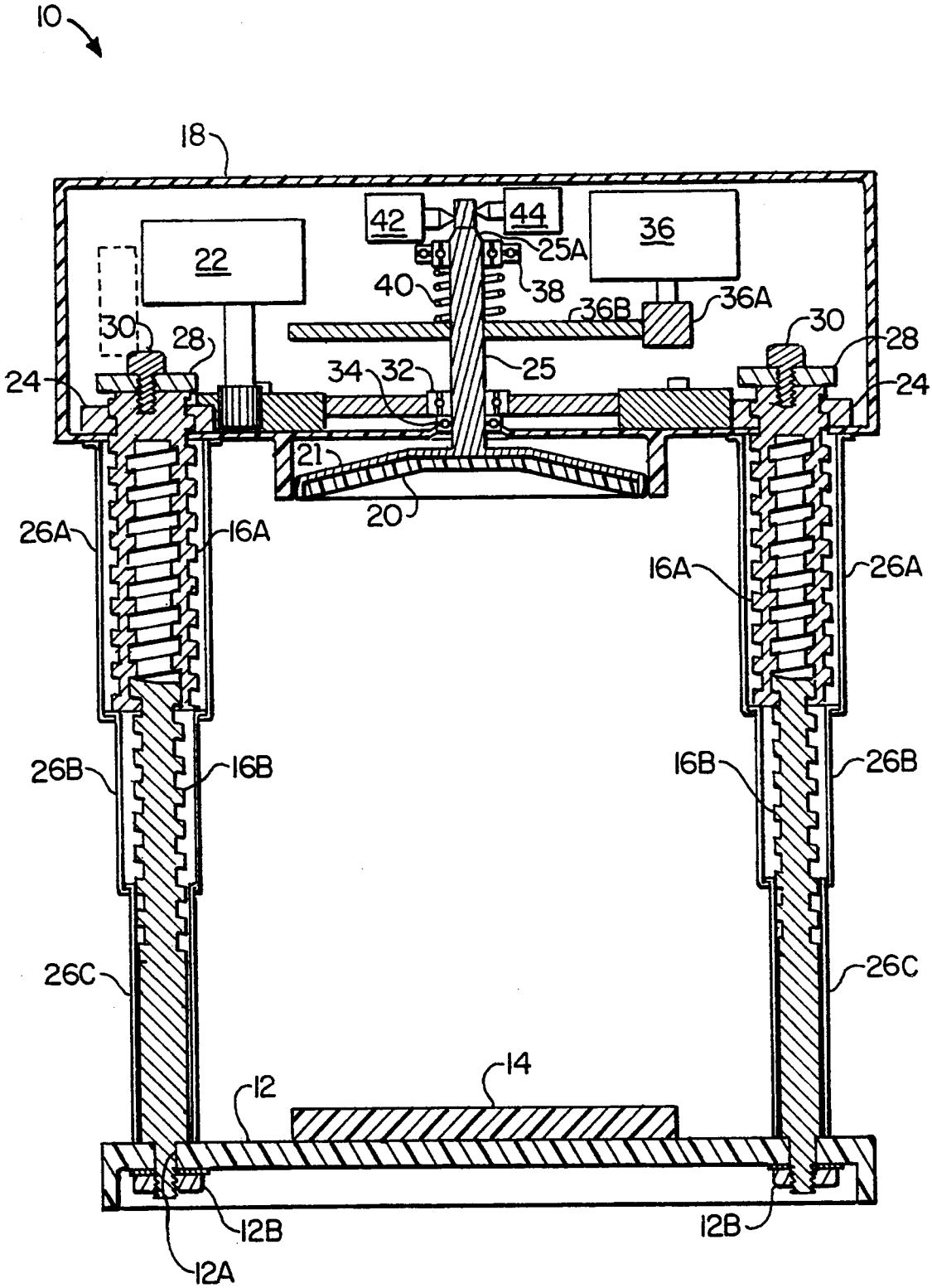
FIG. 4 is a vertical cross sectional view of the automated container closure opener of the present invention.

Upper gripper 20 is fixed to shaft 25 which extends upwardly through bearings 32 and 34 in FIG. 4 of the drawings. Gripper 20 and shaft 25 can rotate within bearings 32 and 34 as controlled by motor 36 through gears 36A and 36B (as best shown in FIGS. 4 and 5 of the patent drawings). The gripper 20 and shaft 25 can move axially a limited distance within bearings 32 and 34 as well as upper bearing 38. As upper gripper 20 descends onto the bottle cap, the upper gripper shaft 25 moves upward in bearings 32, 34 and 38, thus compressing sensor spring 40 between gear 36B fixed on shaft 25 and upper thrust bearing 38. Spring 40 is calibrated to compress to a selected value, usually between 10 and 50 pounds, to allow shaft 25 to rise a calibrated distance. Having moved that distance, it actuates switch 42 at the preset force. Switch 42 is positioned to be actuated from concentric ramp 25A at the top of gripper shaft 25. The last part of the upward vertical movement of shaft against the spring force actuates switch 42. Switch when actuated, disconnects elevator motor 22 from its electricity source and in turn connects cap motor 36 to its electricity source. Cap motor 36, through its gearing, then turns upper gripper 20 with the now engaged bottle cap in order to loosen the cap.

As the cap turns on the bottle, the cap follows the bottle thread upward and this causes the cap to rise an additional small distance. This rise forces upper gripper 20 upwardly a small additional distance against the resilient resistance of sensor spring 40 and actuates sensor switch 44 from the same concentric ramp 25A of shaft 25. Switch 44 disconnects cap motor 36 from its electricity source thus stopping the cap loosening rotation of gripper 20.

From this point where the bottle cap C is loose but still on the bottle B, elevator motor 22 will automatically be reconnected to its electrical source in a reverse direction in order to raise upper gripper 20 from cap C or, alternatively, the operator may press release switch s to engage elevator motor 22 in a reverse direction to release bottle B through operator control.

Electric power is provided to the controls and driving mechanisms through an electric cord (not shown) entering the base and passing up through one of the telescoping posts to the control circuitry in the upper housing.

Control Circuit

Figure 6:
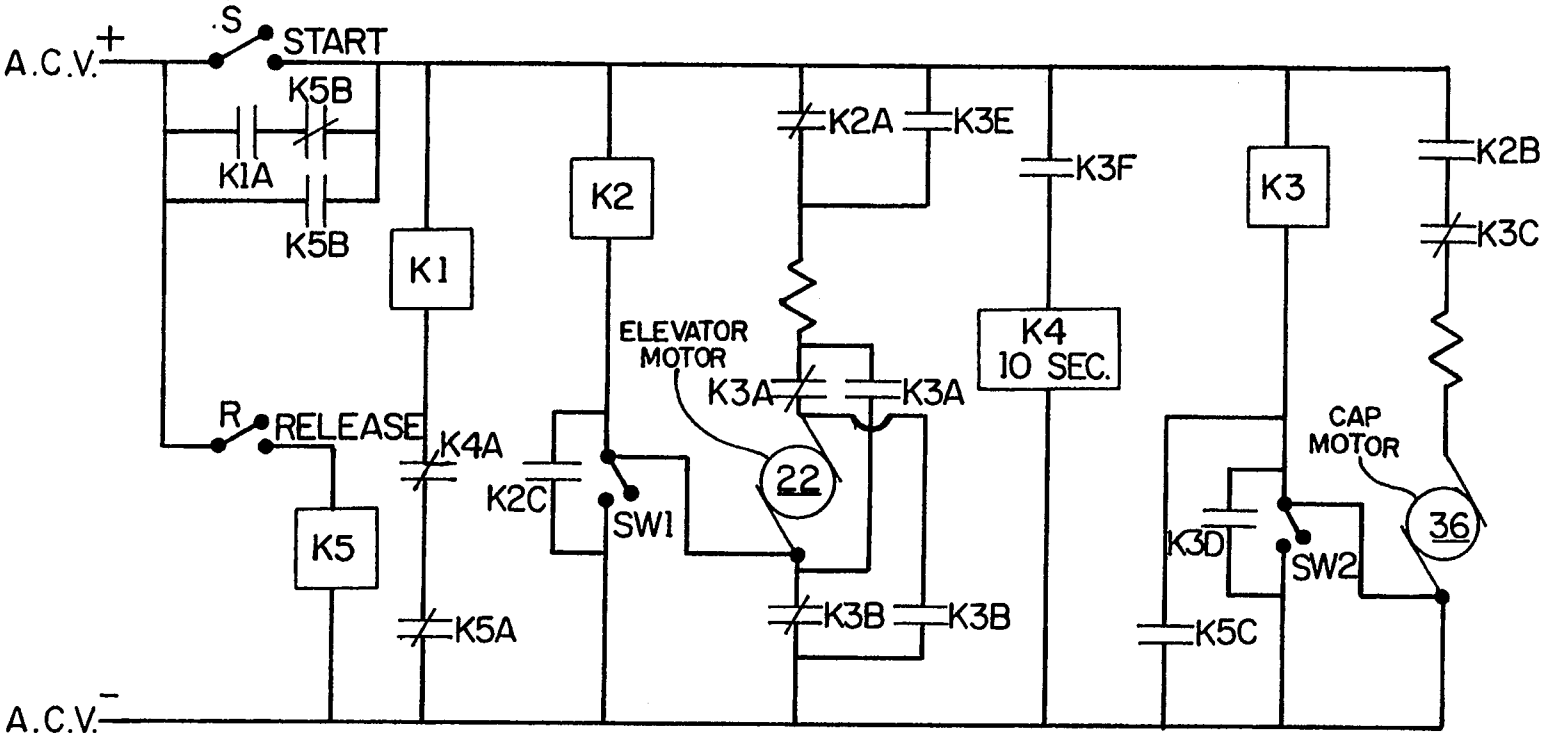
FIG. 6 is a simplified schematic wiring diagram of a representative circuit for the automated container closure opener of the present invention.
Figure 7:
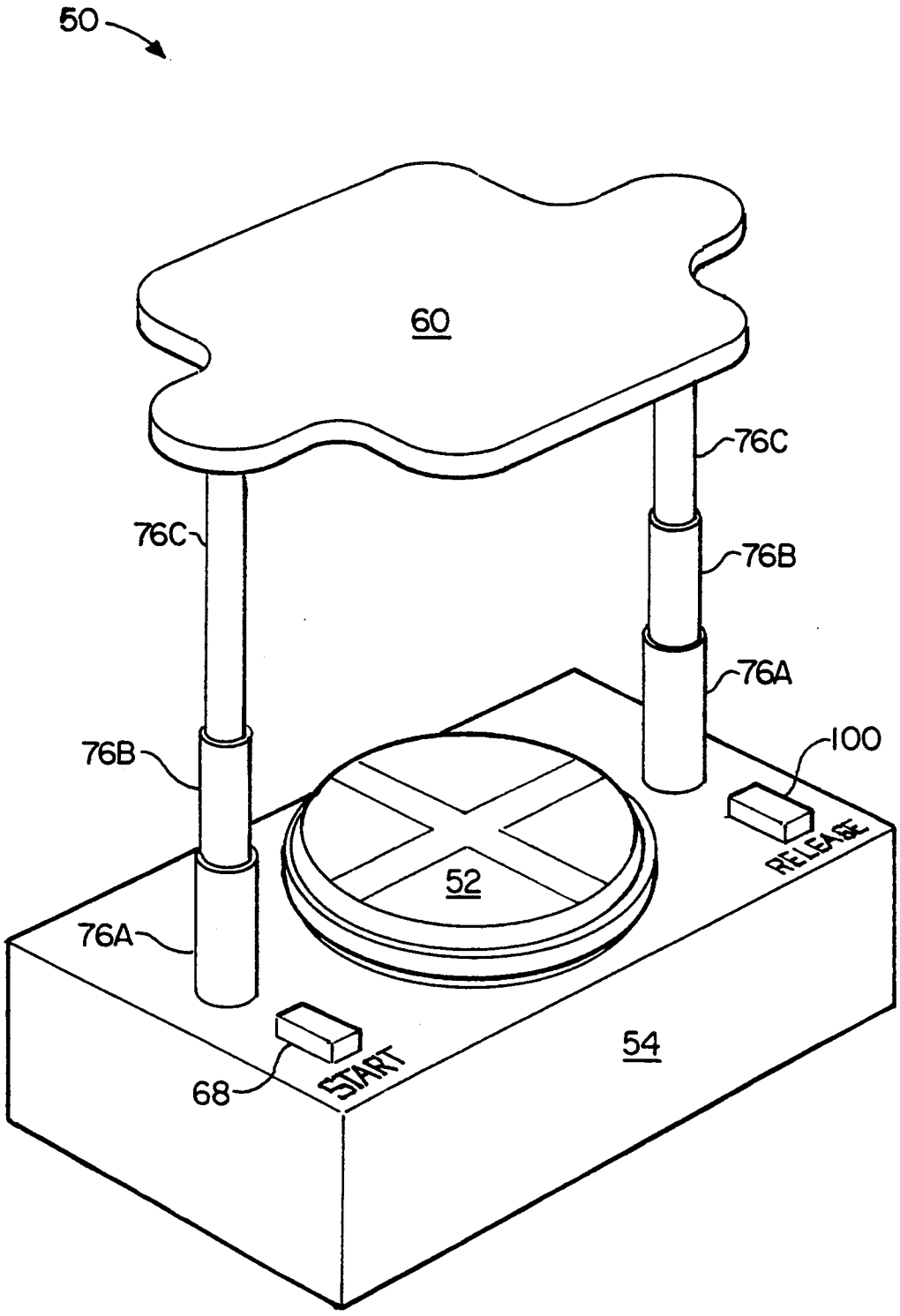
FIG. 7 is a perspective view of an alternative embodiment of the automated container closure opener of the present invention.
Figure 9:
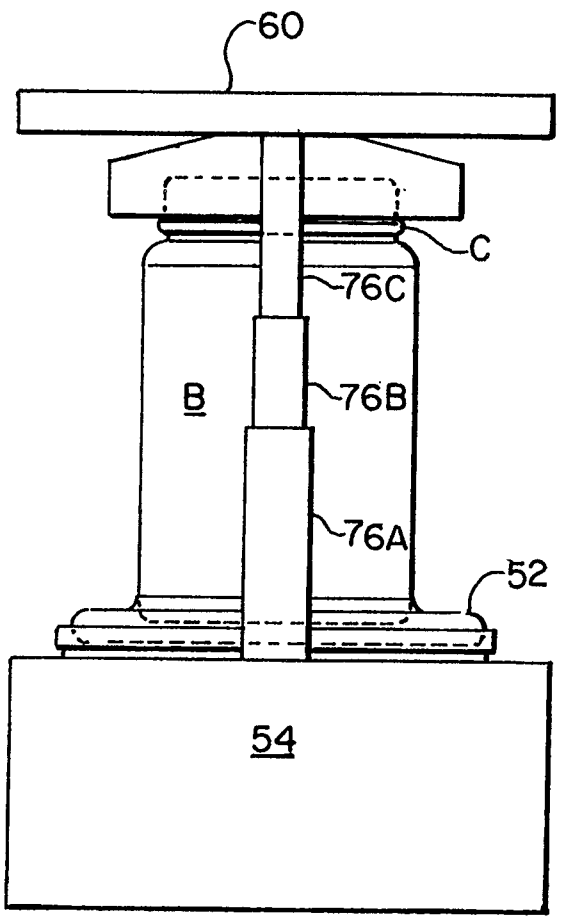
FIG. 9 is a side elevation view of the automated container closure opener of FIG. 7.
Figure 8:
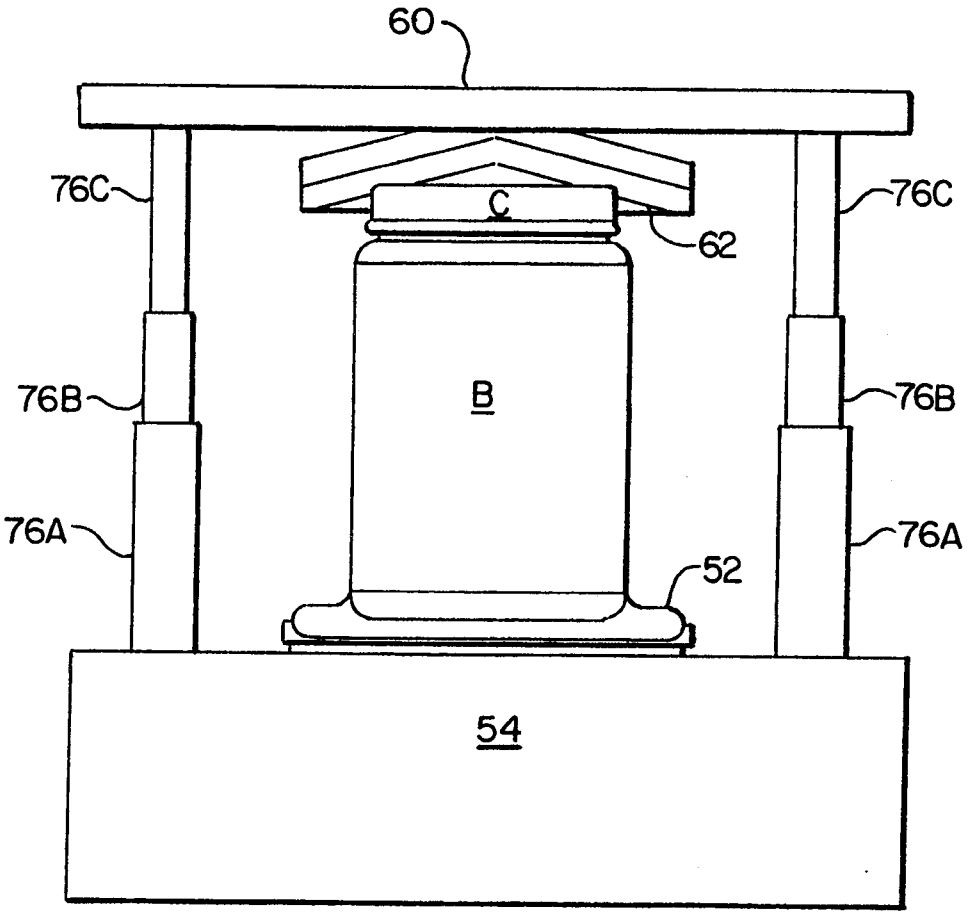
FIG. 8 is a front elevation view of the automated container closure opener of FIG. 7.
Figure 10:
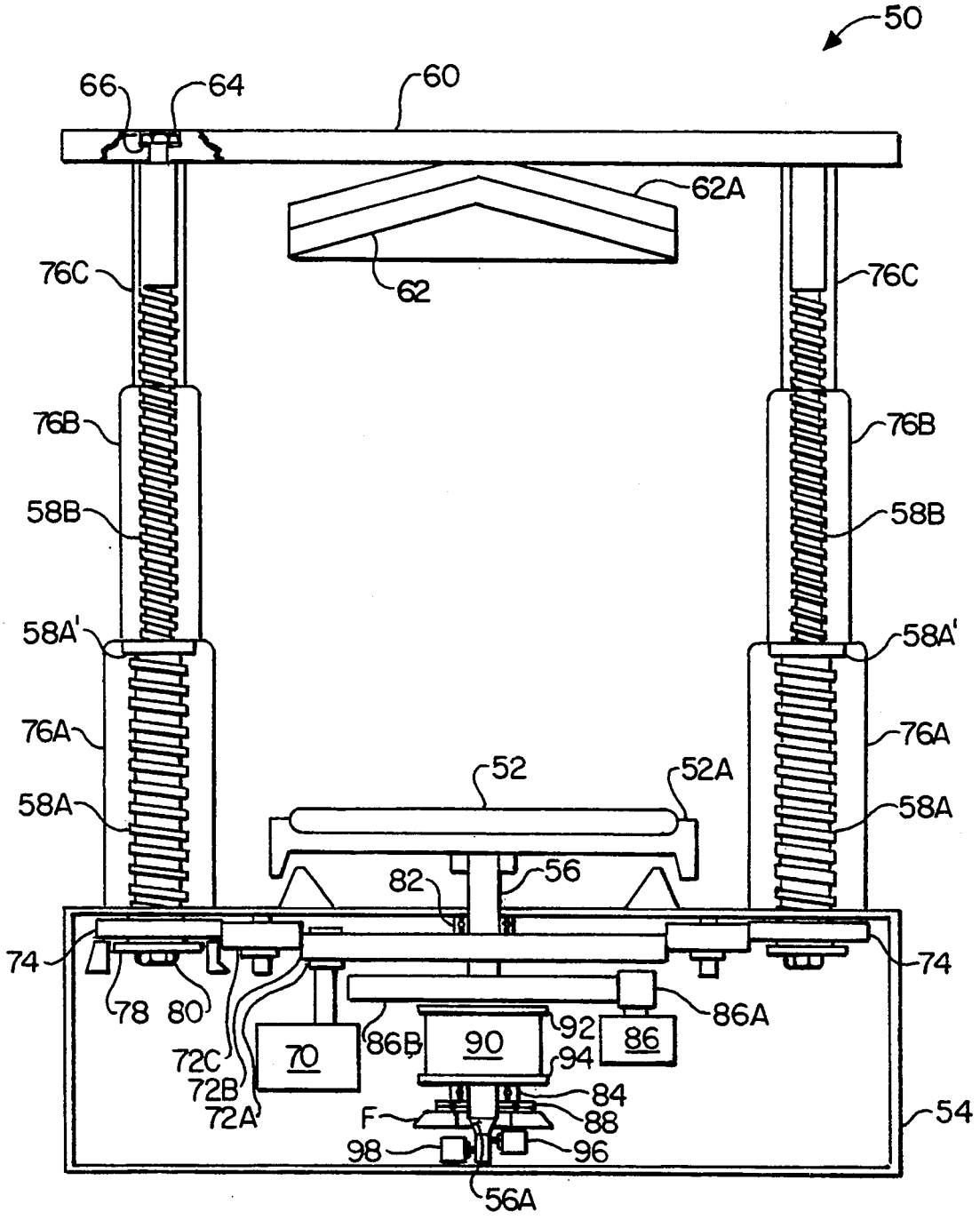
FIG. 10 is a vertical cross-sectional view of the automated container closure opener of FIG. 7.
Figure 11:
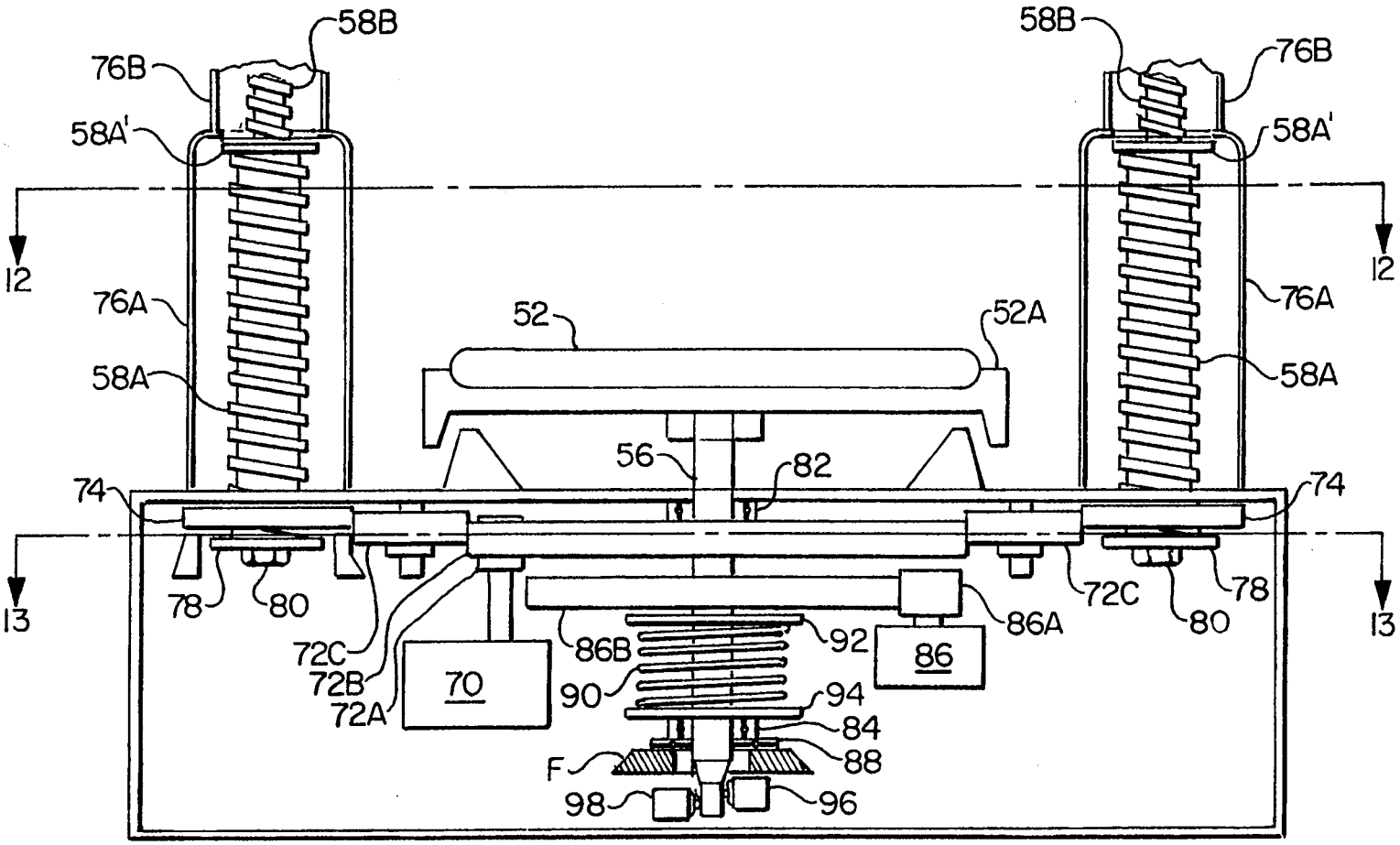
FIG. 11 is an enlarged vertical cross-sectional view of the lower housing of the automated container closure opener of FIG. 7.
Figure 12:
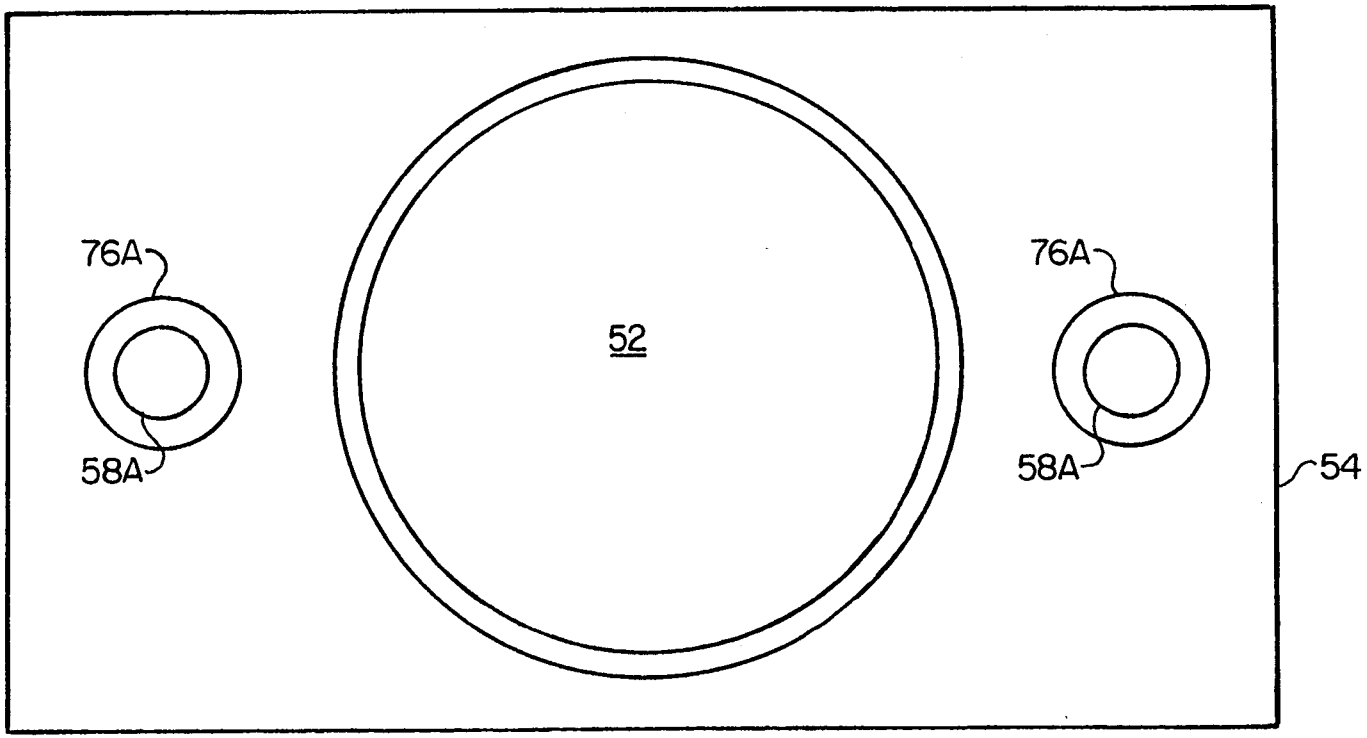
FIG. 12 is a view taken along lines 12—12 of FIG. 11.
Figure 13:
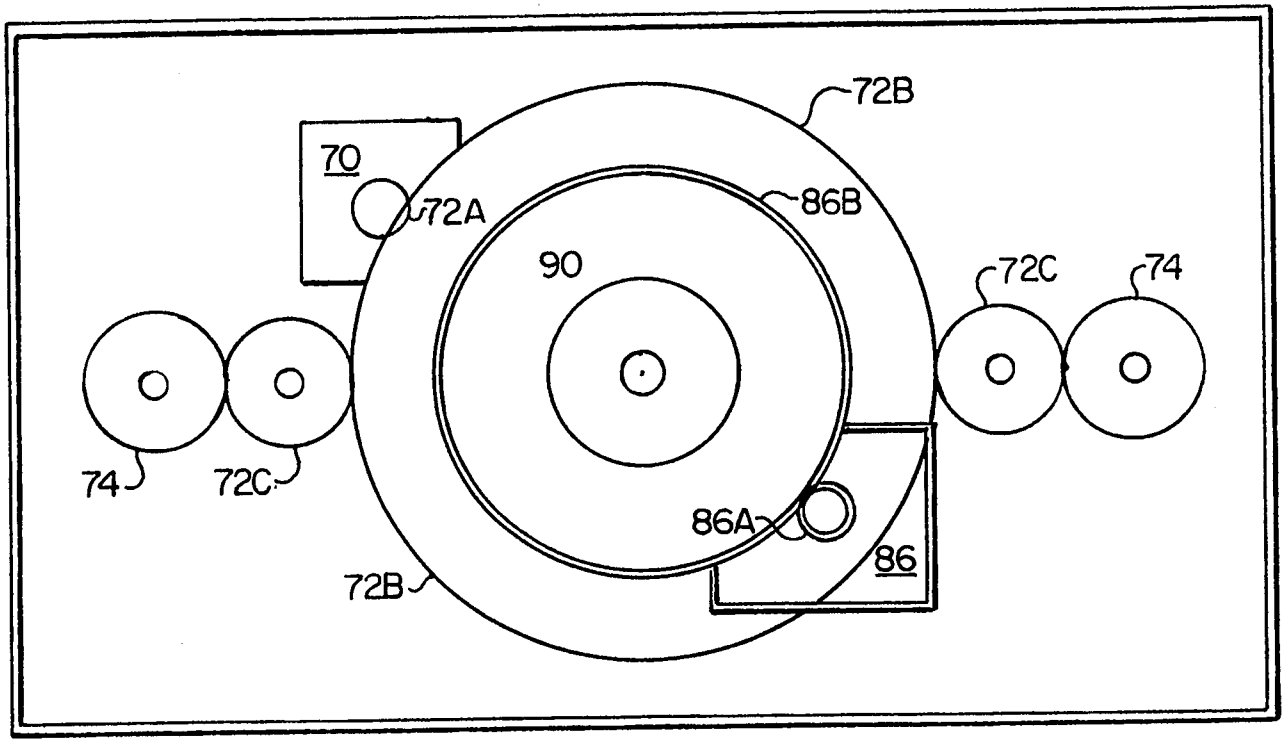
FIG. 13 is a view taken along lines 13—13 of FIG. 11.
Figure 14:
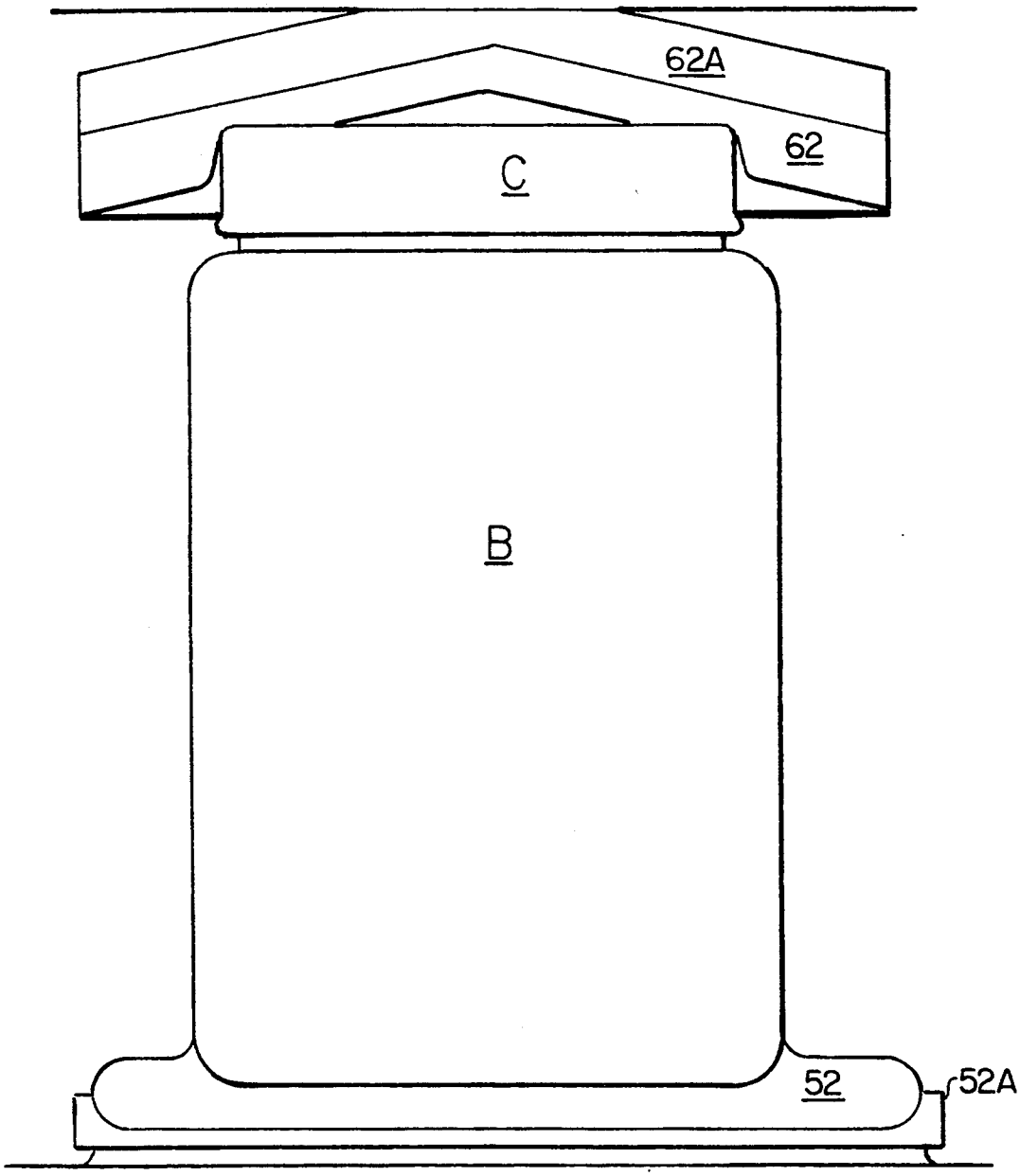
FIG. 14 is an enlarged vertical cross-sectional view of a bottle and cap clamped between the upper and lower grippers of the automated container closure opener of FIG. 7.

A representative control circuit shown in FIG. 6 uses electromagnetic relays, electric motors, micro-action electric switches, and push button momentary manual switches. Most relays are multi-pole break-before-make type rated for continuous duty, and K3 most suitably comprises two (2) relays in parallel to provide six (6) form C contacts. The electric motors are continuous duty, reversible, sub-fractional horsepower, and self-limiting to withstand continuous stall. All of the individual components are easily available from common sources in the electrical control and component industry and would be well known to one skilled in the art. The circuitry could also be constructed using current state-of-the-art semiconductor circuitry and controls.

In operation, pressing start button S energizes relay coil K1 through normally closed contacts on relays K4*a* and K5*a*. Relay K1 then seals itself in (maintains its own energizing path) through normally open contacts K1*a*, and normally closed contacts K5*b*. The path through start switch S, or its sealed-in bypass, also energizes elevator motor 22 in the forward direction through the normally closed contacts K2*a*, K3*a*, and K3*b*. Motor 22 moves housing 18 downwardly to grip bottle cap C.

When housing 18 and upper gripper 20 move the required distance, the mechanism actuates control switch SW1, which is normally open. Closing SW1 energizes relay K2 which seals itself in through normally open contacts K2*c* and de-energizes elevator motor 22 by opening the normally closed contact K2*a*.

Actuating relay K2 also closes its normally open contact K2*b* so as to energize cap motor 36 through normally closed contacts K3*c*. The cap motor turns until it actuates the cap sensor switch SW2. Closing the normally open sensing switch SW2 energizes relay K3 which seals itself in through normally open contacts K3*d* around the switch. Normally closed contacts K3*c* open so as to de-energize cap motor 36 and cause cap motor 36 to stop.

Energizing relay K3 for the above cap motor control also operates the elevator motor reversing circuit which comprises the four contacts K3*a* normally open and normally closed, and K3*b* normally open and normally closed. Since K2 was previously energized and is still energized, its normally closed contact K2*a* is held open. Contact K3*e* bypasses open contact K2*a* to re-energize motor 22 in the reverse direction. The connection reverses motor armature current direction relative to its field polarity. The elevator motor operation in the reverse direction is just long enough to release the force on bottle B and release the bottle. Therefore, normally open contact K3*f* closes when elevator motor 22 starts in the reverse direction to initiate ten second delay relay K4. The delay action in the relay causes K4 to actuate ten seconds after it is energized. The ten second value is arbitrary to the design and is for purpose of example only and not for limitation.

Finally, normally closed contact K4*a* opens to de-energize K1. When K1 releases, it drops contact K1*a* which was held in to bypass or seal around the start switch and consequently turns off the whole control circuit system. Start switch S can re-initiate the whole sequence again from this point.

It should also be understood that release switch R can be actuated to cause elevator motor 22 to move in the reverse (upward) direction at any time in the cycle to release the pressure on bottle B and cap C. The release motion continues only as long as the release switch R is held depressed. Pressing release switch R energizes relay K5 through the normally open momentary switch. K5 normally closed contact K5*b* opens around the start switch, and normally open K5*b* closes around the same start switch to give relay K5 the control and not relay K1. Normally closed contact K5*a* opens to release K1 completely.

K5 normally open contact K5*c* closes around sensor switch SW2 to energize relay K3 as was done previously to stop cap motor 36 and energize elevator motor 22 in the reverse direction. K5 remains energized only while release switch R is held depressed. When the switch is released, K5 drops out releasing the bypass around start switch S and disconnecting the elevator motor circuit power and de-energizing all other controls, thus stopping all further action.

Applicant would also note that while the sensing device in the preferred embodiment of the invention is essentially a cam and plunger actuating a pair of small electric switches mounted at the top of the upper housing, alternative constructions can use well known torque sensitive or torque limited electric motors wherein the sensed force is in proportion to motor current or motor speed.

ALTERNATIVE EMBODIMENT OF THE INVENTION

Applicant also contemplates a second embodiment of the present invention wherein the drive mechanism is positioned within the lower housing of the automated container closure opener to provide a lower center of gravity and greater resistance to being inadvertently turned over by the user or other proximate person.

Referring now to FIGS. 7–15 of the drawings, the automated container closure opener is generally designated as 50 therein. Lower gripper 52 protrudes from the top of lower housing 54 and is fixed to shaft 56. Telescoping shafts 58A, 58B extend upward through lower housing 54 to upper platform 60 which has upper gripper 62 fixedly attached. Shafts 58B are firmly secured to upper platform 60 with appropriate fastening devices such as nuts 64 and washers 66.

Depressing START switch 68 on lower housing 54 energizes elevator motor 70 which through gears 72A–72C turns gear-nuts 74 on screw-threaded telescoping elevator shafts 58A so as to cause shafts 58A to descend so as to clamp bottle B with cap C between upper and lower grippers 62 and 52, respectively.

Grippers 62 and 52 each have a cover layer of resilient elastomeric polymer of the type often popularly described as a form of silicon rubber, with a slightly gummy or adhesive rubber-like surface. Formulation of the upper and lower gripper elastomeric elements may vary from each other to allow for the differences in size and texture of caps and bottles. Upper gripper 62 has a bottle closure-engaging surface formed from the elastomeric material which is attached to a rigid, slightly concave, support 62A. Support 62A is firmly fixed to upper platform 60 and is stationary with relation to it. The conical design of upper gripper 62 accommodates a firm holding grip on a wide variety of types and sizes of caps. Lower gripper 52 similarly has a bottle engaging upper surface formed from elastomeric material attached to a firm backing member 52A. Shaft 56 with lower gripper 52 attached can rotate as a unit and can also move vertically, as described hereinafter, to open bottle B.

Bottle B rests on the upper engagement surface of lower gripper 52. When START switch 68 is actuated, upper platform 60 descends; upper gripper 62 contacts cap C and squeezes down onto bottle B and cap C, pushing bottle B firmly into lower gripper 52 and pushing cap C firmly into upper gripper 62. The conical design of upper gripper 62 also helps the gripper to center bottle B in the gripper surface for better application of the rotational force (to be explained later) to loosen cap C. That is, the cone shape of upper gripper 62 lets bottle B slide toward the center of gripper 62 as vertical clamping force is applied.

Telescoping elevator shafts 58A, 58B are helically threaded screws covered with smooth collapsible covers 76A–76C for safety and appearance. Internally threaded shafts 58A turn on fixed externally threaded shafts 58B, drawing shafts 58B into the cavities of shafts 58A to shorten the combined shaft length and draw upper platform 60 downward.

Internally threaded gear-nuts 74 turning on the external threads of shafts 58A and thrusting against the underside of lower housing 54 draws shafts 58A downward into lower housing 54. Shafts 58A bring shafts 58B and upper platform 60 downward with them as they descend. In this fashion closure opener 50 can accommodate bottles of varying heights from tall to very short. Telescoping shafts 58A, 58B reduce the size of lower housing 54 and provide advantages in compactness, cleanliness, and storage.

Gear-nuts 74 have internal threads to match the external threads of shafts 58A and external gear teeth to mate with gears 72A–72C. The lower ends of shafts 58A are each fitted with a stop comprised of washer 78 and nut 80 to prevent shafts 58A from threading out of gear-nuts 74 when moving in reverse rotation. Similarly, the upper ends of shafts 58A include a thread stop 58A', shown as a collar formed on the top of the shafts, to prevent shafts 58A from threading downward completely through gear-nuts 74.

To explain still further, the telescoping action of shafts 58A and 58B along with gear-nuts 74 works in the following manner. Elevator motor 70 through gears 72A–72C turns gear-nuts 74 on lower shafts 58A so as to draw shafts 58A down into lower housing 54 and consequently to move upper platform 60 downward. Gear 72B is free to rotate on shaft 56 independently of movement of shaft 56 and is also free to move slightly in a vertical direction on shaft 56. When shafts 58A, 58B descend fully into gear-nuts 74, flanges 58A' at the top of shafts 58A prevent further movement of shafts 58A, 58B into gear-nuts 74. Continued turning of gear-nuts 74 turns lower shafts 58A along with gear-nuts 74 to thread upper shafts 58B downward into the cavities of lower shafts 58A and continues to move upper platform 60 downward. The downward motion continues until motor 70 is stopped by a vertical sensing device (to be described below) or until the shaft actuates a limit switch (which is not shown). It is unimportant if gear-nuts 74 move relative to lower shafts 58A first or if shafts 58A turn on shafts 58B first, since the telescoping action is the same.

Outer telescoping covers 76A–76C are provided over telescoping shaft sections 58A, 58B to promote cleanliness, appearance, and protection from the moving threads. The telescoping covers may be of a light plastic tube material of three different diameters with upper cover sections 76C attached to upper platform 60 and lower cover sections 76A attached to lower housing 54. Appropriate stops on the ends of the cover sections (not shown) prevent smaller cover sections from completely withdrawing from the next larger cover section.

Lower gripper 52 is fixed to shaft 56 which extends downward into lower housing 54. Shaft 56 with lower gripper 52 can rotate within bearings 82 and 84 and is also controlled by cap motor 86 through gears 86A and 86B. Lower gripper 52 and shaft 56 can move axially downward a limited distance within bearings 82, 84, and 88.

As upper platform 60 with upper gripper 62 moves downward against bottle B and cap C placed between the upper and lower grippers, gripper shaft 56 moves downward in bearings 82, 84, and 88, compressing sensor spring 90 between collar 92, which is firmly fixed to shaft 56, and the combination of washer 94 and lower thrust bearing 88 and frame stop F. Spring 90 is calibrated to compress with a specified force, usually 10 to 50 pounds, to allow shaft 56 to descend a calibrated distance. Having moved that distance, shaft 56 actuates switch 96 at a preset force. Switch 96 is positioned to be actuated from concentric ramp 56A on the bottom of gripper shaft 56. The last part of the vertical movement of shaft 56 against the spring force actuates switch 96.

Switch 96, when actuated, disconnects elevator motor 70 from its electrical source and in turn connects cap motor 86 to its electrical source. Cap motor 86 through gears 86A and 86B then turns lower gripper 52, with its now engaged bottle B, to loosen cap C which is pressed against stationary upper gripper 62. As bottle B turns in cap C, the bottle follows the threads on the bottle and cap downward causing bottle B to descend an additional small distance. The additional incremental downward movement of lower gripper 52 and shaft 56 against the force of sensor spring 90 actuates sensor switch 98 from the same concentric ramp 56A on shaft 56. Switch 98 disconnects cap motor 86 from its electrical source thus stopping the cap loosening rotation of lower gripper 52.

From this point where bottle cap C is loose but still on bottle B, elevator motor 70 is automatically reconnected to its electrical source in the reverse direction, and through gears 72A–72C raises upper gripper 62 from the cap. Alternatively, the operator may press RELEASE switch 100 to engage elevator motor 70 in a reverse direction to release the force on bottle B and cap C at any desired time or position in the cycle.

Electric power is provided to apparatus 50 through an electric cord (not shown) entering lower housing 54. Control circuit parts (also not shown) are also housed in lower housing 54.

Control Circuit

Figure 15:
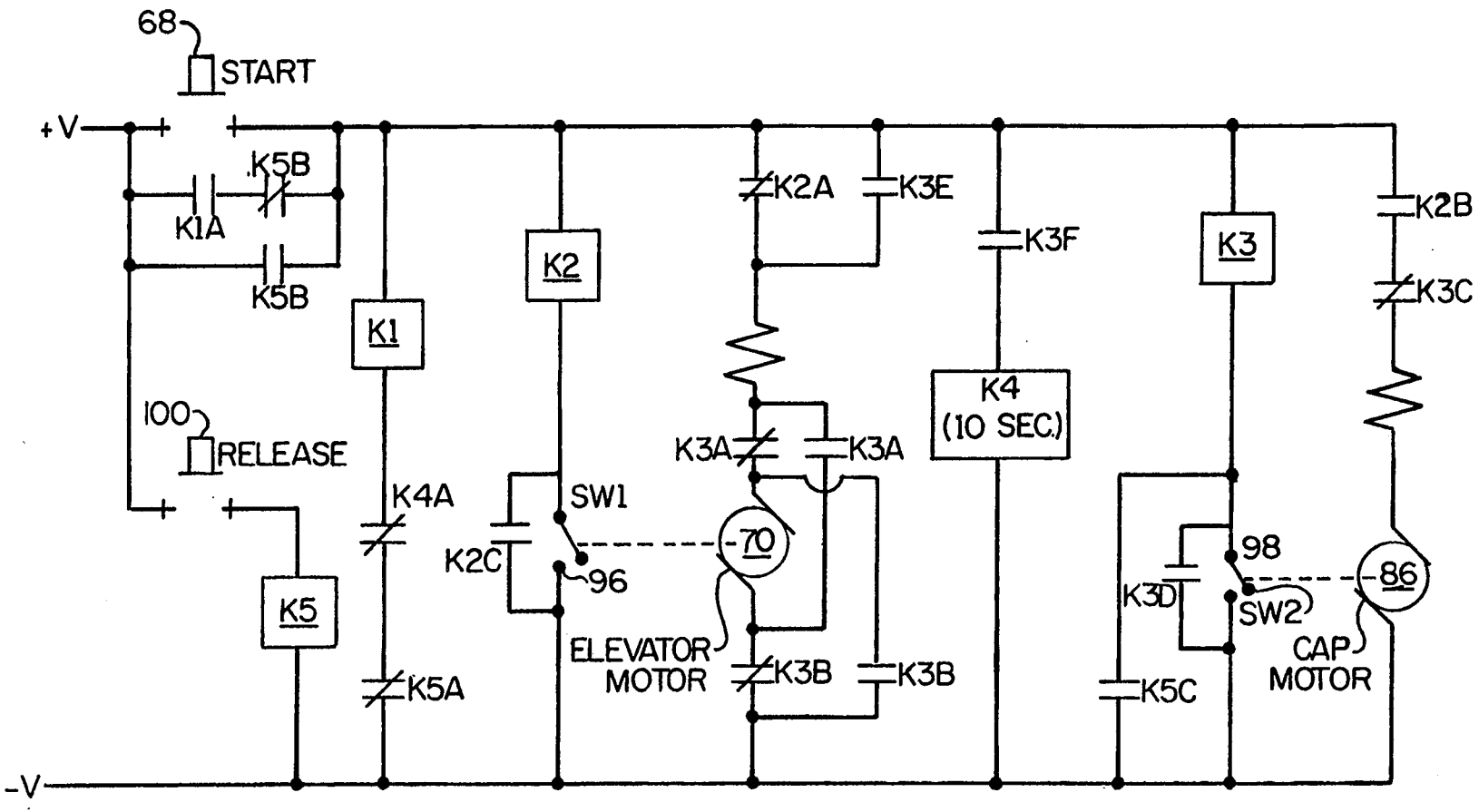
FIG. 15 is a simplified schematic wiring diagram of a representative circuit for the automated container closure opener of FIG. 7.

A representative control circuit shown in FIG. 15 uses electromagnetic relays, electric switches, and push button momentary manual switches. Most relays are multi-pole break-before-make type rated for continuous duty, and K3 most suitably comprises two (2) relays in parallel to provide six (6) form C contacts. The electric motors are continuous duty, reversible, sub-fractional horsepower, and self-limiting to withstand continuous stall. All of the individual components are easily available from common sources in the electrical control and component industry and would be well known to one skilled in the art. The circuitry could also be constructed using current state-of-the-art semiconductor circuitry and controls.

In operation, pressing the START switch 68 energizes relay coil K1 through normally closed contacts K4A and K5A. Relay K1 then seals itself in (maintains its own energizing path) through normally open contacts K1A, and normally closed contacts K5B. The path through the START switch, or its sealed-in bypass, also energizes elevator motor 70 in the forward direction through the normally closed contacts K2A, K3A, and K3B. Motor 70 moves upper platform 60 and upper gripper 62 downward to grip the bottle cap.

When upper platform 60 with upper gripper 62 moves downward the required distance, the mechanism actuates control switch 96 (SW1), which is normally open. Closing switch 96 energizes relay K2 which seals itself in through normally open contacts K2C and de-energizes elevator motor 70 by opening the normally closed contact K2A.

Actuating relay K2 also closes its normally open contact K2B to energize cap motor 86 through normally closed contacts K3C. Cap motor 86 turns until it actuates cap sensor switch 98 (SW2). Closing normally open sensing switch 98 energizes relay K3 which seals itself in through normally open contacts K3D around switch 98. Normally closed contacts K3C open to de-energize cap motor 86 and cause it to stop.

Energizing relay K3 for the above cap motor control also operates elevator motor reversing circuits which comprise the four contacts K3A normally open and normally closed, and K3B normally open and normally closed. Since K2 was previously energized and is still energized, its normally closed contact K2A is held open. Contact K3E bypasses open contact K2A to re-energize motor 70 in the reverse direction. The connection reverses motor armature current direction relative to its field polarity. The elevator motor operation in the reverse direction is adjusted to be just long enough to release the force on bottle B and allow bottle B and cap C be freely removed. Therefore, normally open contact K3F closes when elevator motor 70 starts in the reverse direction to initiate ten second delay relay K4. The delay action in the relay causes K4 to actuate ten seconds after it is energized. The ten second value is arbitrary to the design and is for purpose of example only and not for limitation. Finally, normally closed contact K4A opens to de-energize K1. When K1 releases, it drops contact K1A which was held in to bypass or seal around START switch 68 and consequently turns off the whole control circuit system. START switch 68 can re-initiate the whole sequence again from this point.

It should also be understood that RELEASE switch 100 can be actuated to cause elevator motor 70 to move in the reverse (upward) direction at any time in the cycle to release the pressure on bottle B and cap C. In this case, the release motion continues only as long as the RELEASE switch 100 is held depressed. Pressing RELEASE switch 100 energizes relay K5 through the normally open momentary switch. K5 normally closed contact K5B opens around START switch 68, and normally open K5B closes around the same START switch 68 to give relay K5 the control and not relay K1. Normally closed contact K5A opens to release K1 completely. K5 normally open contact K5C closes around sensor switch 98 to energize relay K3 as was done previously to stop cap motor 86 and energize elevator motor 70 in the reverse direction. K5 remains energized only while RELEASE switch 100 is held depressed. When the switch is released, K5 drops out and releases the bypass around START switch 68 and disconnects the elevator motor circuit power and de-energizes all other controls, thus stopping all further action.

Applicant would also note that while the sensing device in the preferred embodiment of the invention is essentially a cam and plunger actuating a pair of small electric switches mounted at the bottom of the lower housing, alternative construction can use well-known torque sensitive or torque limited electric motors wherein the sensed force is in proportion to motor current or motor speed, and these constructions are contemplated to be within the scope of the invention.

It will be understood that various details of the invention may be changed without departing from the scope of the invention. Furthermore, the foregoing description is for the purpose of illustration only, and not for the purpose of limitation-the invention being defined by the claims.

What is claimed is:

1. A bottle or container closure opener for use with screw-type bottle or container caps comprising:

a housing comprising a base portion with a rotatably mounted platform for rotatably supporting a bottle, and a relatively vertically movable top portion positioned above said base portion;

at least one telescoping shaft operatively connecting said top portion to said bottom portion of said housing;

first motorized drive means carried by said base portion of said housing for actuating said telescoping shaft so as to vertically lower and raise said top portion of said housing relative to said base portion;

a bottle cap engagement member fixedly depending from said top portion of said housing and comprising a bottle cap friction engaging surface;

second motorized drive means carried by said base portion of said housing for actuating said rotatably mounted platform in the bottle cap loosening direction; and circuit means for actuating said first motorized drive means so as to lower said bottle cap engagement member from an inoperative position above a bottle cap into engaging contact with the cap of a bottle positioned on said base portion of said housing and to then deactuate said first motorized drive means and to actuate said second motorized drive means so that said rotatably mounted platform at least partially removes the cap from said bottle.

2. A bottle or container closure opener according to claim 1 wherein said rotatably mounted platform is adapted to be urged axially downwardly into a first axially displaced position when said bottle cap engagement member is lowered into frictionally engaging contact with the cap of a bottle and into a second axially displaced position when the cap is at least partially removed by said bottle cap engagement member.

3. A bottle or container closure opener according to claim 2 wherein said circuit means includes a first switch for deactuating said first motorized drive means and actuating said second motorized drive means when said rotatably mounted platform is axially urged downwardly to said first axially displaced position and a second switch for deactuating said second motorized drive means when said rotatably mounted platform is axially urged downwardly to said second axially displaced position.

4. A bottle or container closure opener according to claim 1 wherein said rotatably mounted platform comprises an elastomeric pad.

5. A bottle or container closure opener according to claim 1 wherein said at least one spaced-apart telescoping shaft comprises two telescoping shafts wherein each shaft comprises a first externally helically threaded shaft element secured to said base portion of said housing and a second internally and externally helically threaded shaft element which telescopically receives said first shaft element.

6. A bottle or container closure opener according to claim 1 wherein said first motorized drive means comprises a motor and gear assembly for driving a gear screw operably connected to said telescoping shaft.

7. A bottle or container closure opener according to claim 1 wherein said bottle cap friction engaging surface of said bottle cap engagement member comprises an elastomeric material defining a generally conical shape for receiving a bottle cap.

8. A bottle or container closure opener according to claim 7 wherein said bottle cap engagement member comprises a rigid support plate behind said elastomeric material.

9. A bottle or container closure opener according to claim 1 wherein said second motorized drive means comprises a motor and gear assembly for rotatably driving the shaft of said rotatably mounted platform.

10. A bottle or container closure opener according to claim 1 wherein said circuit means deactuates said second motorized drive means when the cap has been at least partially removed from said bottle and again actuates said first motorized drive means so as to raise said bottle cap engagement member back to its inoperative position.

11. A bottle or container closure opener for use with screw-type bottle or container caps comprising:

a housing comprising a base portion with a rotatably mounted platform for rotatably supporting a bottle, and a relatively vertically movable top portion positioned above said base portion;

at least two spaced-apart telescoping shafts operatively connecting said top portion to said bottom portion of said housing;

first motorized drive means carried by said base portion of said housing for actuating said telescoping shafts so as to vertically lower and raise said top portion of said housing relative to said base portion;

a bottle cap engagement member fixedly depending from said top portion of said housing and comprising a bottle cap friction engaging surface, wherein said rotatably mounted platform is adapted to be urged axially downwardly into a first axially displaced position when said bottle cap engagement member is lowered into engaging contact with the cap of a bottle and downwardly into a second axially displaced position when the cap is at least partially removed by said bottle cap engagement member;

second motorized drive means carried by said base portion of said housing for rotatably actuating said rotatably mounted platform in the bottle cap loosening direction; and circuit means for actuating said first motorized drive means so as to lower said bottle cap engagement member from an inoperative position above a bottle cap into engaging contact with the cap of a bottle positioned on said base portion of said housing and to then deactuate said first motorized drive means and to actuate said second motorized drive means so that said rotatably mounted platform at least partially removes the cap from said bottle, wherein said circuit means includes a first switch for deactuating said first motorized drive means and actuating said second motorized drive means when said rotatably mounted platform is axially urged downwardly to said first axially displaced position and a second switch for deactuating said second motorized drive means when said rotatably mounted platform is axially urged downwardly to said second axially displaced position.

12. A bottle or container closure opener according to claim 11 wherein said rotatably mounted platform comprises an elastomeric pad.

13. A bottle or container closure opener according to claim 11 wherein said at least two spaced-apart telescoping shafts comprises two telescoping shafts wherein each shaft comprises a first externally helically threaded shaft element secured to said base portion of said housing and a second internally and externally helically threaded shaft element which telescopically receives said first shaft element.

14. A bottle or container closure opener according to claim 11 wherein said first motorized drive means comprises a motor and gear assembly for driving a plurality of gear screws each being operably connected to a respective one of said telescoping shafts.

15. A bottle or container closure opener according to claim 11 wherein said bottle cap friction engaging surface of said bottle cap engagement member comprises an elastomeric material defining a generally conical shape for receiving a bottle cap.

16. A bottle or container closure opener according to claim 15 wherein said bottle cap engagement member comprises a rigid support plate behind said elastomeric material.

17. A bottle or container closure opener according to claim 11 wherein said second motorized drive means comprises a motor and gear assembly for rotatably driving the shaft of said rotatably mounted platform.

18. A bottle or container closure opener according to claim 11 wherein said circuit means deactuates said second motorized drive means when the cap has been at least partially removed from said bottle and again actuates said first motorized drive means so as to raise said bottle cap engagement member back to its inoperative position.

* * * * *